US006923706B1

(12) United States Patent
Arias

(10) Patent No.: US 6,923,706 B1
(45) Date of Patent: Aug. 2, 2005

(54) AQUATIC TOYS

(75) Inventor: David A. Arias, Virginia Beach, VA (US)

(73) Assignee: Swimways Corp., Virginia Beach, VA (US)

( * ) Notice: Subject to any disclaimer, the term of this patent is extended or adjusted under 35 U.S.C. 154(b) by 0 days.

(21) Appl. No.: 10/776,981

(22) Filed: Feb. 11, 2004

(51) Int. Cl.[7] ..... A63H 22/00; A63H 23/04
(52) U.S. Cl. ..... 446/153; 446/155
(58) Field of Search ..... 446/153, 154, 446/155; 441/156, 129, 130, 131; 472/128; 434/254

(56) References Cited

U.S. PATENT DOCUMENTS

| | | | | | |
|---|---|---|---|---|---|
| 954,544 | A | * | 4/1910 | Sanford | 446/153 |
| 1,639,607 | A | | 8/1927 | Beulab | |
| 2,932,916 | A | * | 4/1960 | Strickland | 446/156 |
| 3,014,723 | A | | 12/1961 | Butler | |
| 3,095,197 | A | * | 6/1963 | Weitzman | 273/350 |
| 3,323,795 | A | | 6/1967 | Quello | |
| 3,332,166 | A | * | 7/1967 | Alexander | 446/431 |
| 3,895,801 | A | | 7/1975 | Baird | |
| 3,897,647 | A | * | 8/1975 | Black | 43/42.38 |
| 4,268,989 | A | | 5/1981 | Wickham | |
| 4,515,572 | A | * | 5/1985 | Emms | 446/153 |
| 4,707,869 | A | | 11/1987 | Ray | |
| 4,744,565 | A | * | 5/1988 | Newberger | 273/342 |
| 5,096,453 | A | * | 3/1992 | Van Meter | 446/73 |
| 5,141,440 | A | * | 8/1992 | Wallingford | 434/254 |
| 5,141,441 | A | | 8/1992 | Wallingford | |
| 5,329,714 | A | * | 7/1994 | Lee | 40/409 |
| 5,538,454 | A | * | 7/1996 | Kessler | 446/236 |
| 5,603,176 | A | * | 2/1997 | Eddins et al. | 40/409 |
| 5,722,871 | A | * | 3/1998 | Zamir | 446/153 |
| 5,845,697 | A | | 12/1998 | Zheng | |
| D425,357 | S | | 5/2000 | Waring | |
| 6,088,953 | A | | 7/2000 | Morgan | |
| D429,310 | S | * | 8/2000 | Diliberti | D22/132 |
| 6,170,100 | B1 | | 1/2001 | Le Gette et al. | |
| 6,332,822 | B2 | * | 12/2001 | Greenberg et al. | 446/153 |
| 6,343,391 | B1 | | 2/2002 | Le Gette et al. | |
| 6,478,038 | B1 | | 11/2002 | Le Gette et al. | |
| 6,485,344 | B2 | | 11/2002 | Arias | |
| 6,511,074 | B1 | * | 1/2003 | Fireman | 273/350 |
| 6,519,793 | B2 | | 2/2003 | Le Gette et al. | |
| 6,575,185 | B2 | | 6/2003 | Zheng | |
| 6,595,227 | B2 | | 7/2003 | Le Gette et al. | |
| 6,641,787 | B1 | * | 11/2003 | Siggins et al. | 422/264 |
| 6,699,535 | B2 | * | 3/2004 | Boschert | 428/15 |

OTHER PUBLICATIONS

Copending application of David A. Arias, U.S. Appl. No. 10/817,293, dated Apr. 2, 2004.

* cited by examiner

*Primary Examiner*—Derris H. Banks
*Assistant Examiner*—Faye Francis

(57) ABSTRACT

An aquatic toy that is capable of maintaining a desired form and position in water, which includes a fabric portion, at least one hollow opening formed in the fabric portion, wherein buoyancy and or weight of or attached to the fabric portion provide at least partial form to a perimeter of the hollow opening.

18 Claims, 6 Drawing Sheets

AQUATIC TOYS

BACKGROUND OF THE INVENTION

Field of the Invention

This invention relates generally to aquatic toys.

SUMMARY OF THE INVENTION

The present invention relates to an aquatic toy that is generally weighted and/or buoyed such that, when placed in a body of water, such as, for example, a swimming pool, the aquatic toy is capable of maintaining a desired form and position in the water. In various exemplary embodiments, the aquatic toy is generally weighted and/or buoyed such that it is capable of maintaining a desired vertical or horizontal position in the water. In this manner, a swimmer may, in various exemplary embodiments, swim through the hollow opening formed by the frame member.

In various exemplary embodiments, the fabric portion is in the shape of an object, plant, animal, or other character.

In various exemplary embodiments, weights and/or buoys are positioned in or on certain areas of the fabric portion such that, when placed in a body of water, the fabric portion of the aquatic toy is capable of being maintained in a relatively opened position so that the object, plant, animal, or other character formed by the fabric portion is visible.

Depending upon the degree of weight and/or buoyancy provided to various portions of the aquatic toy, certain portions of the aquatic toy may have a relatively negative buoyancy while other portions of the aquatic toy may have a relatively positive buoyancy. If the aquatic toy has a relatively negative overall buoyancy, the aquatic toy will sink to the bottom of, for example, a swimming pool, until at least a portion of the aquatic toy is in contact with the bottom of the pool.

If the aquatic toy has a relatively positive overall buoyancy, the aquatic toy will float towards the top surface of the water in the swimming pool, until at least a portion of the aquatic toy reaches the top surface of the water.

If the aquatic toy has a relatively neutral overall buoyancy, the aquatic toy will float at a given depth in the water in the swimming pool.

Accordingly, this invention provides an aquatic toy, which, when placed in a body of water, is capable of maintaining a desired form and position in the water.

This invention separately provides an aquatic toy, which may be easily folded or collapsed when not in use.

This invention separately provides an aquatic toy, which is simple and cost effective.

These and other features and advantages of this invention are described in or are apparent from the following detailed description of the exemplary embodiments.

BRIEF DESCRIPTION OF THE DRAWINGS

The exemplary embodiments of this invention will be described in detail, with reference to the following figures, wherein like reference numerals refer to like parts throughout the several views, and wherein.

DETAILED DESCRIPTION OF THE PREFERRED EMBODIMENT

For simplicity and clarification, the design factors, construction, and layout of the aquatic toys according to this invention are explained with reference to various exemplary embodiments of an aquatic toy according to this invention. The basic explanation of the operation of the aquatic toy is applicable for the understanding and design of the constituent components employed in the aquatic toys of this invention.

It should be appreciated that, for simplicity and clarification, the embodiments of this invention will be described with reference to several exemplary embodiments of the aquatic toy, wherein the fabric portion is in the shape of an animal or seaweed. However, it should be appreciated that the fabric portion of the aquatic toys of this invention may take the shape of any object, plant, animal, or other character.

It should also be appreciated that, for simplicity and clarification, the embodiments of this invention will be shown and/or described with reference to the aquatic toys having a hollow opening having a generally circular shape. However, the generally circular geometry of the hollow opening is intended to be illustrative, not limiting. Thus, it should be understood that the overall geometry of the hollow opening may comprise any overall geometry, including, for example, a generally square, rectangle, triangular, pentangular, circular, oval, elliptical, star, or other shape.

Figure 1:
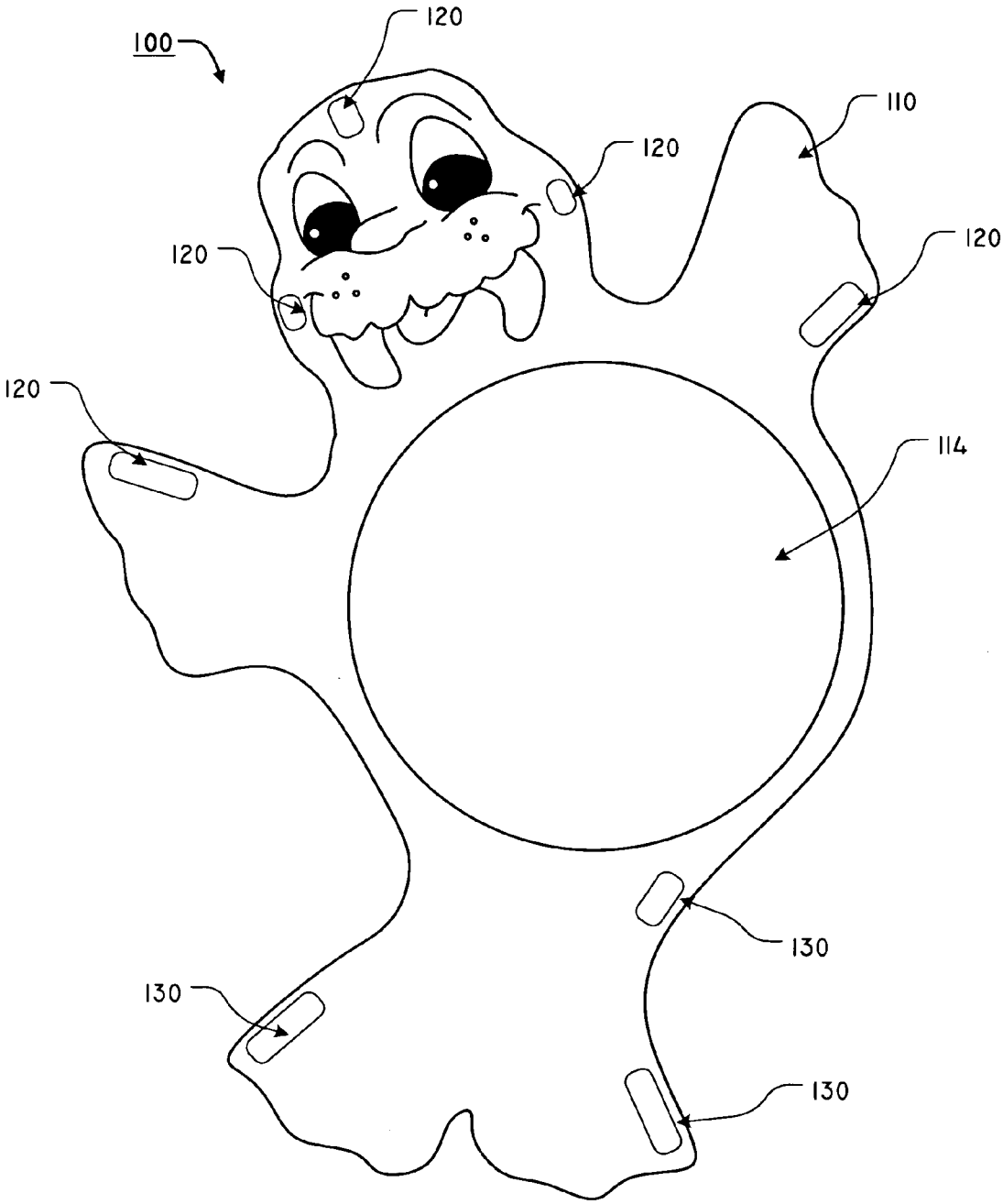
FIG. 1 shows a front view of a first exemplary embodiment of an aquatic toy in a fully expanded or open configuration according to this invention.

FIG. 1 shows a front view of a first exemplary embodiment of an aquatic toy 100 according to this invention. As shown in FIG. 1, the aquatic toy 100 is in a fully expanded or open configuration and includes at least some of a fabric portion 110, at least one optional buoyancy element 120, and at least one optional weight element 130.

As shown in FIG. 1, the fabric portion 110 is in the general shape of a walrus. However, it should be appreciated that the fabric portion of the aquatic toys of this invention may be in the shape of any object, plant, animal, or other character.

In various exemplary embodiments, the fabric portion 110 is made of a lightweight fabric or other material and may include woven fabrics, sheet fabrics, films, nylon, spandex, vinyl, Polyvinyl Chloride (PVC), neoprene, or the like. Additionally, the fabric portion 110 may be made of any flexible and/or elastic material and may stretch. Alternatively, the fabric portion 110 may be formed from multiple materials. The fabric may be water-resistant and durable enough to withstand the wear and tear associated with an aquatic toy that is appropriate for outdoor and/or pool use. In various exemplary embodiments, the fabric portion 110 may include a cushion material.

It should be appreciated that the terms fabric and material are to be given their broadest meanings and that the particular fabric or material used to form the fabric portion 110 is a design choice based on the desired appearance, wearability, buoyancy, and/or functionality of the aquatic toy 100.

In various exemplary embodiments, the fabric portion 110 may have a relatively negative, neutral, or positive buoyancy, such that the fabric portion 110 may provide at least some negative, neutral, or positive buoyancy to the aquatic toy 100 or at least a portion of the aquatic toy 100.

A hollow opening 114 is formed in the fabric portion 110 of the aquatic toy 100. The size, position, and overall geometry of the hollow opening 114 may vary and is a design choice based on the desired appearance and/or functionality of the aquatic toy 100. However, in various exemplary embodiments, the hollow opening 114 may be large enough that an average youngster can swim through the hollow opening 114.

As further shown in FIG. 1, the aquatic toy 100 includes at least one optional buoyancy element 120 and at least one optional weight element 130. Each optional buoyancy element 120 may be comprised of foam, Styrofoam® or any other multicellular expanded synthetic resin, cork, an inflated or inflatable pocket or bladder, plastic, rubber, wood, or an equivalent, or any other known or later developed material or system capable of providing a determined level of relatively buoyancy to the aquatic toy 100.

Each optional weight element 130 may be comprised of metal, a weighted or weightable pocket or bladder, plastic, rubber, wood, or an equivalent, or any other known or later developed material or system capable of providing a determined level of relatively weight to the aquatic toy 100.

Each optional buoyancy element 120 is placed such that a particular region or portion of the aquatic toy 100 and/or the fabric portion 110 has a determined relatively buoyancy, while each optional weight element 130 is placed such that a particular region or portion of the aquatic toy 100 and/or the fabric portion 110 has a determined relatively weight.

In this manner, certain portions of the aquatic toy 100 and/or certain portions of the fabric portion 110 are generally buoyed and/or weighted such that when the aquatic toy 100 is placed in a body of water, such as, for example, a swimming pool, the aquatic toy 100 is capable of maintaining a desired form and position in the water. Likewise, sufficient structure or tension is provided to at least a portion of the fabric portion 110 and/or the perimeter of the hollow opening 114 to hold the hollow opening 114 in an expanded or open configuration and provide form to the hollow opening 114.

In various exemplary embodiments, each optional buoyancy element 120 and each optional weight element 130 is placed or positioned in or on certain areas of the fabric portion 110 such that, when the aquatic toy 100 is placed in a body of water, the fabric portion 110 is capable of being maintained in a relatively opened position so that the object, plant, animal, or other character formed by the fabric portion 110 is visible.

In various exemplary embodiments, the optional buoyancy element(s) 120 and the optional weight element(s) 130 are not used and the buoyancy and/or weight is provided to the aquatic toy 100 and/or certain portions of the fabric portion 110 by the material used in certain areas of the fabric portion 110.

The material used to form the fabric portion 110 may provide sufficient weight and/or buoyancy to maintain the aquatic toy 100 in the desired form and position in water. In these embodiments, the fabric portion 110 may be formed of a naturally weighted or buoyant material or various portions of the fabric portion 110 may be formed of a naturally weighted or buoyant material.

It should be appreciated that any combination of optional buoyancy elements 120, optional weight elements 130, and weighty and/or buoyant fabric portion(s) 110 may be used.

As illustrated in FIG. 1, the aquatic toy 100 is in the general shape of a walrus and includes exemplary buoyancy elements 120 and exemplary weight elements 130 positioned such that the fabric portion 110 is maintained in a relatively open position and the aquatic toy 100 may be maintained in a relatively vertical position in water.

Figure 2:
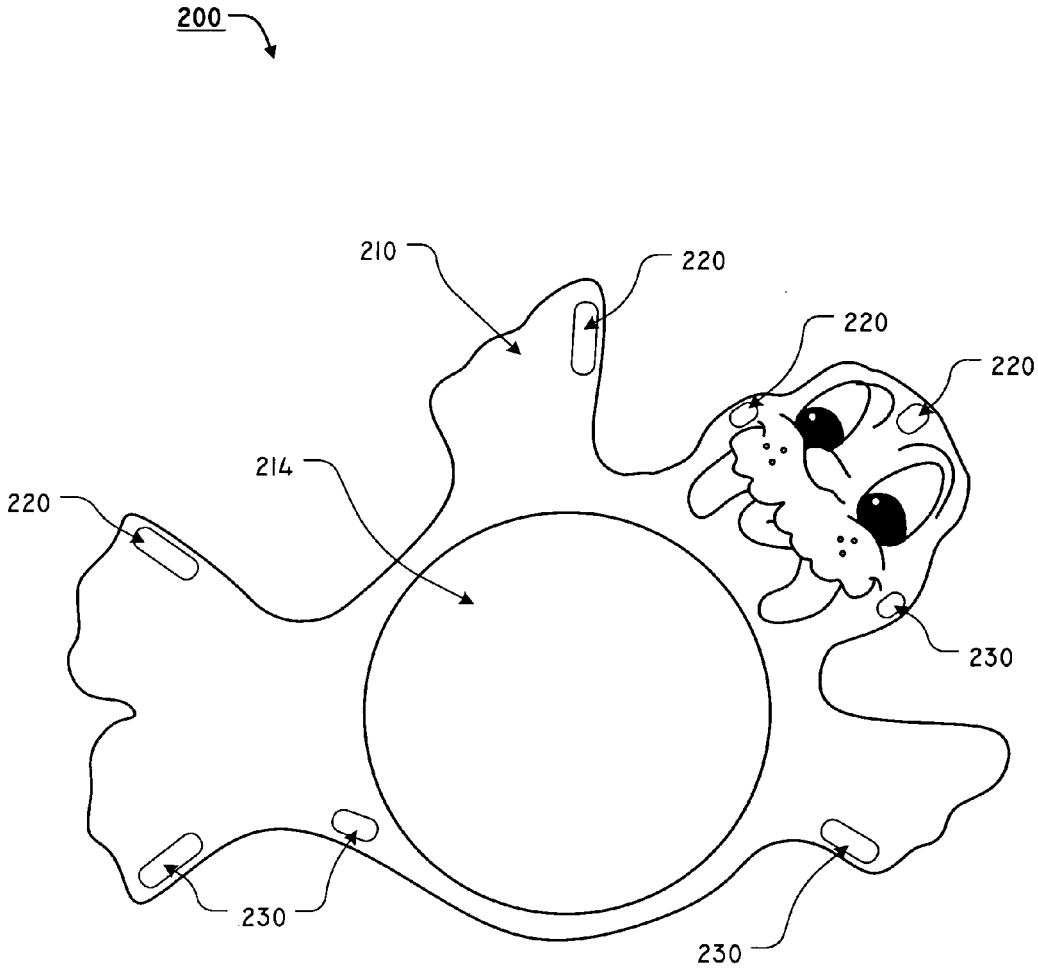
FIG. 2 shows a front view of the second exemplary embodiment of the aquatic toy in a fully expanded or open configuration according to this invention.

FIG. 2 shows a front view of a second exemplary embodiment of the aquatic toy in a fully expanded or open configuration according to this invention. As shown in FIG. 2, the aquatic toy 200 includes at least some of a fabric portion 210, a hollow opening 214, at least one optional buoyancy element 220, and at least one optional weight element 230.

It should be understood that each of these elements corresponds to and operates similarly to the fabric portion 110, the hollow opening 114, the at least one optional buoyancy element 120, and the at least one optional weight element 130, as described above with reference to FIG. 1. However, as shown in FIG. 2, the aquatic toy 200 includes exemplary buoyancy elements 220 and exemplary weight elements 230 positioned such that the fabric portion 210 is maintained in a relatively open position and the aquatic toy 200 may be maintained in a relatively horizontal position in water.

Figure 3:
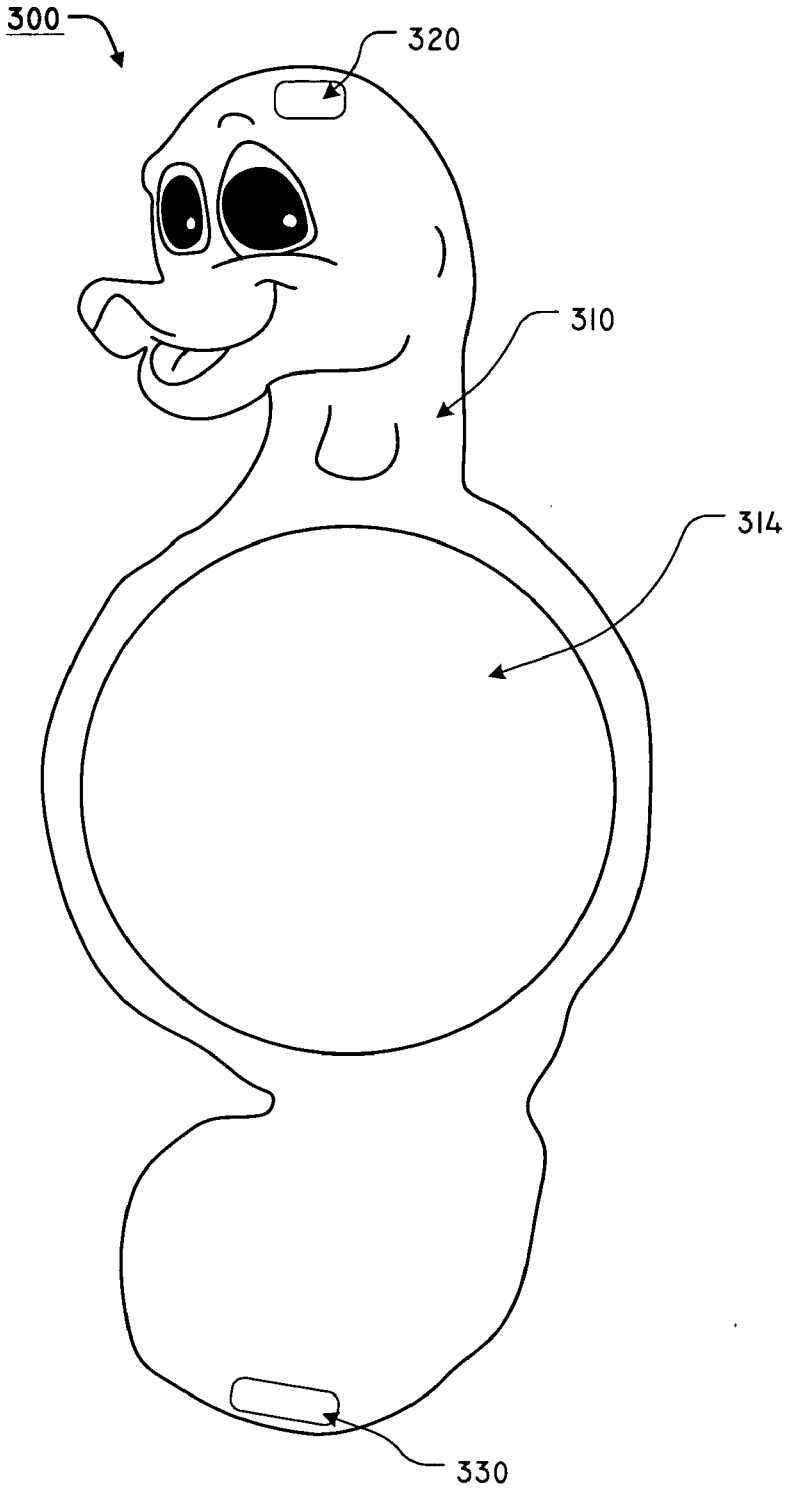
FIG. 3 shows a front view of the third exemplary embodiment of an aquatic toy in a fully expanded or open configuration according to this invention.

FIG. 3 shows a front view of the third exemplary embodiment of an aquatic toy in a fully expanded or open configuration according to this invention. As shown in FIG. 3, the aquatic toy 300 includes at least some of a fabric portion 310, a hollow opening 314, at least one optional buoyancy element 320, and at least one optional weight element 330.

It should be understood that each of these elements corresponds to and operates similarly to the fabric portion 110, the hollow opening 114, the at least one optional buoyancy element 120, and the at least one optional weight element 130, as described above with reference to FIG. 1. As shown in FIG. 3, the aquatic toy 300 includes an exemplary buoyancy element 320 and an exemplary weight element 330 positioned such that the fabric portion 310 is maintained in a relatively open position and the aquatic toy 300 may be maintained in a relatively vertical position in water.

Figure 4:
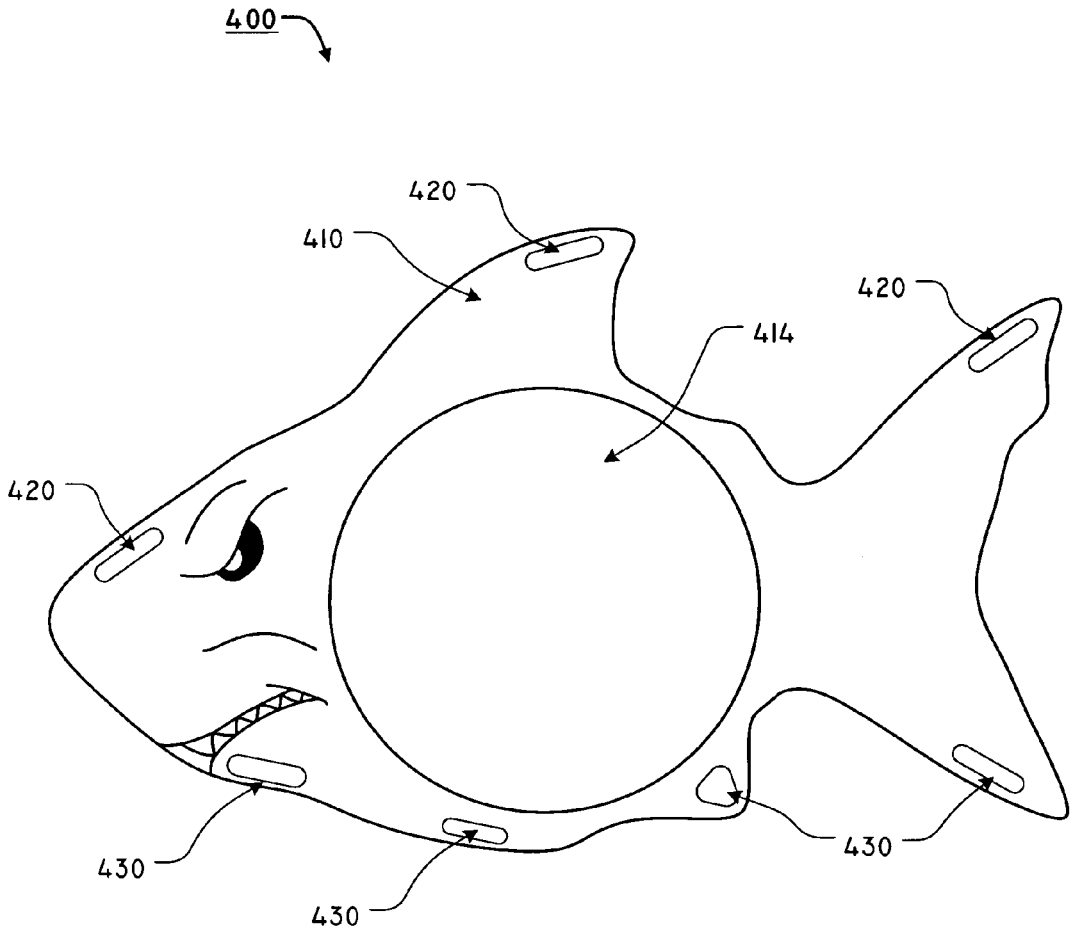
FIG. 4 shows a front view of the fourth exemplary embodiment of an aquatic toy in a fully expanded or open configuration according to this invention.

FIG. 4 shows a front view of the fourth exemplary embodiment of an aquatic toy in a fully expanded or open configuration according to this invention. As shown in FIG. 4, the aquatic toy 400 includes at least some of a fabric portion 410, a hollow opening 414, at least one optional buoyancy element 420, and at least one optional weight element 430.

It should be understood that each of these elements corresponds to and operates similarly to the fabric portion 110, the hollow opening 114, the at least one optional buoyancy element 120, and the at least one optional weight element 130, as described above with reference to FIG. 1. As shown in FIG. 4, the aquatic toy 400 is in the general shape of a shark and includes exemplary buoyancy elements 420 and exemplary weight elements 430 positioned such that the fabric portion 410 is maintained in a relatively open position and the aquatic toy 400 may be maintained in a relatively horizontal position in water.

Figure 5:
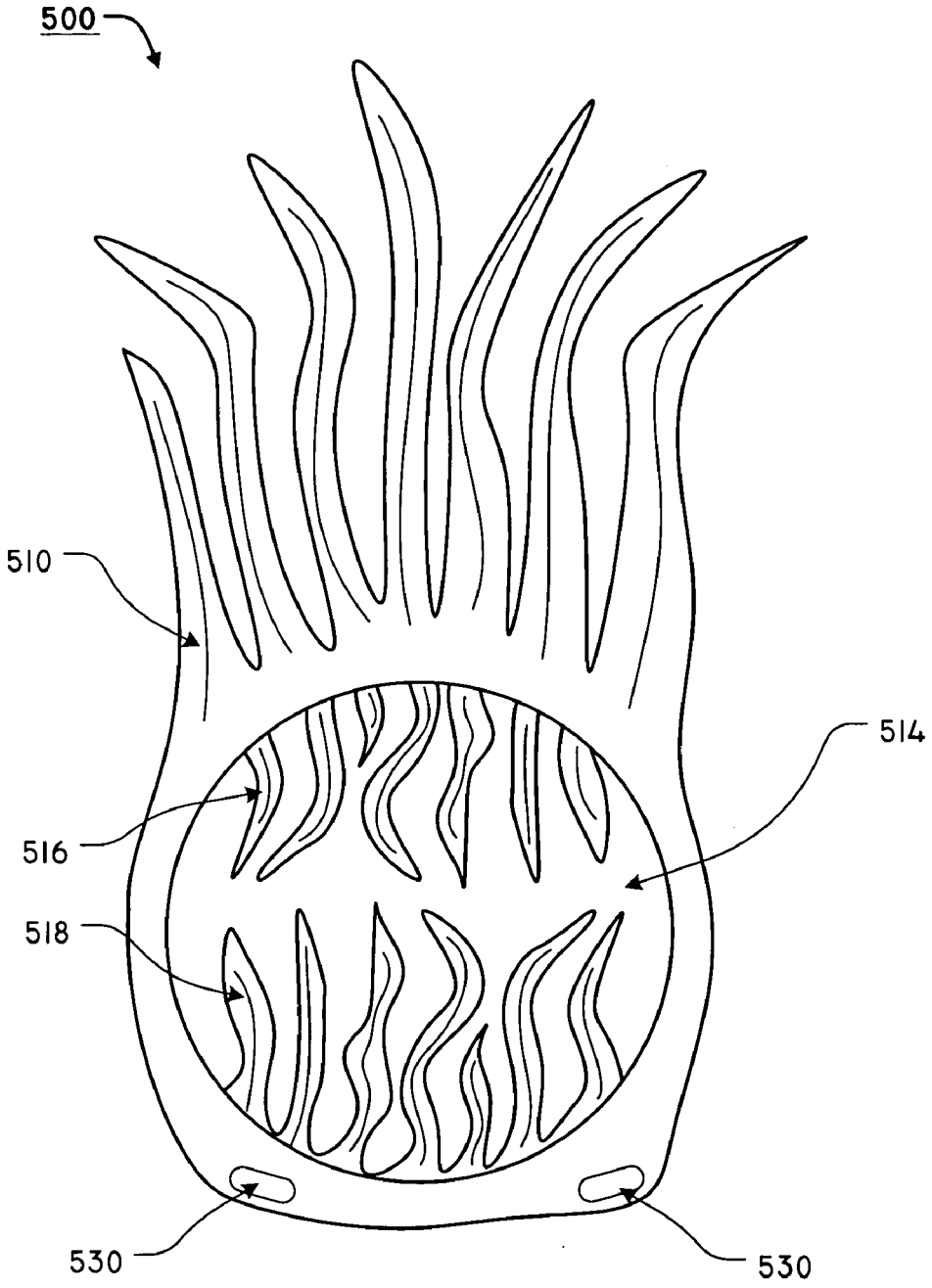
FIG. 5 shows a front view of the fifth exemplary embodiment of an aquatic toy in a fully expanded or open configuration according to this invention.

FIG. 5 shows a front view of the fifth exemplary embodiment of an aquatic toy in a fully expanded or open configuration according to this invention. As shown in FIG. 5, the aquatic toy 500 includes at least some of a fabric portion 510, a hollow opening 514, and at least one optional weight element 530.

It should be understood that each of these elements corresponds to and operates similarly to the fabric portion 110, the hollow opening 114, the at least one optional buoyancy element 120, and the at least one optional weight element 130, as described above with reference to FIG. 1. It should also be understood that the aquatic toy 500 may include at least one optional buoyancy element 520 (not shown).

However, as shown in FIG. 5, the aquatic toy 500 is in the general shape of a mass of seaweed and includes exemplary weight elements 530 positioned such that the aquatic toy 500 may be maintained in a relatively vertical position in water.

As further illustrated in FIG. 5, the aquatic toy 500 also includes a first additional fabric portion 516 and a second additional fabric portion 518. The first additional fabric portion 516 extends substantially downward from an upper portion of the hollow opening 514, while the second additional fabric portion 518 extends substantially upward from a lower portion of the hollow opening 514.

It should be appreciated that the fabric portion 510, the first additional fabric portion 516, and/or the second additional fabric portion 518 may be weighted and/or buoyed using any of the materials or methods described or referenced herein. It should also be appreciated that other additional fabric portions may be added to the aquatic toy 500.

Figure 6:
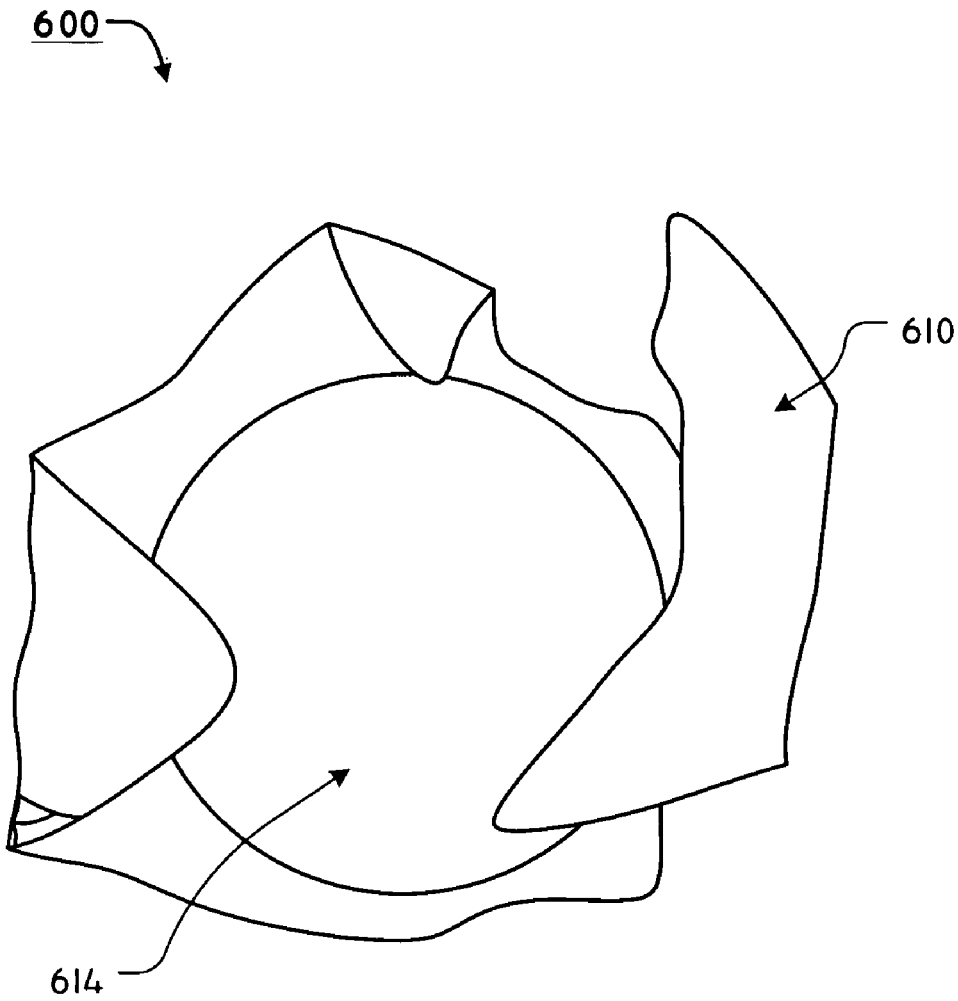
FIG. 6 shows an exemplary embodiment of an aquatic toy being folded or collapsed according to this invention.

FIG. 6 shows an exemplary embodiment of an aquatic toy being folded or collapsed according to this invention. As shown in FIG. 6, the aquatic toy 600 includes at least some of a fabric portion 610, a hollow opening 614, at least one optional buoyancy element 620 (not shown), and at least one optional weight element 630 (not shown).

It should be understood that each of these elements corresponds to and operates similarly to the fabric portion 410, the hollow opening 414, the at least one optional buoyancy element 420, and the at least one optional weight element 430, as described above with reference to FIG. 4. It should also be understood that the aquatic toy 600 may include any of the features and/or embodiments of the aquatic toy, as described above with respect to FIGS. 1–5.

As shown in FIG. 6, the fabric portion 610 of the aquatic toy 600 may be easily folded or collapsed.

While this invention has been described in conjunction with the exemplary embodiments outlined above, it is evident that many alternatives, modifications, and variations will be apparent to those skilled in the art. Accordingly, the exemplary embodiments of the invention, as set forth above, are intended to be illustrative, not limiting. Various changes may be made without departing from the spirit and scope of the invention.

What is claimed is:

1. An aquatic toy that is capable of maintaining a desired form and position in water, comprising:

a fabric portion reconfigurable between a closed position in which it is collapsible and an open position in which it is substantially planar;

at least one opening formed in the fabric portion;

at least one buoyancy member positioned at a selected location on the fabric portion; and at least one weight positioned at a selected location on the fabric portion, the at least one buoyancy member and the at least one weight positioned such that the fabric portion extends into the open position when submerged in water.

2. The aquatic toy of claim 1, wherein the fabric portion comprises at least one of a woven fabric, a sheet fabric, a film, nylon, spandex, vinyl, Polyvinyl Chloride and neoprene.

3. The aquatic toy of claim 1, wherein the fabric portion comprises multiple materials.

4. The aquatic toy of claim 1, wherein at least a portion of the fabric portion has a relatively negative buoyancy, such that the fabric portion provides at least some negative buoyancy to at least a portion of the aquatic toy.

5. The aquatic toy of claim 1, wherein at least a portion of the fabric portion has a relatively neutral buoyancy, such that the fabric portion provides a substantially neutral buoyancy to at least a portion of the aquatic toy.

6. The aquatic toy of claim 1, wherein at least a portion of the fabric portion has a relatively positive buoyancy, such that the fabric portion provides at least some positive buoyancy to at least a portion of the aquatic toy.

7. The aquatic toy of claim 1, wherein the shape of the opening is one of a substantially square shape, a rectangular shape, a pentangular shape, a circular shape, an oval shape, an elliptical shape, and a star shape.

8. The aquatic toy of claim 1, wherein the at least one buoyancy member is placed such that a selected portion of the aquatic toy is buoyant.

9. The aquatic toy of claim 1, wherein the at least one buoyancy member is at least one of foam, a multicellular expanded synthetic resin, cork, an inflated or inflatable pocket or bladder, plastic, rubber, and wood.

10. The aquatic toy of claim 1, wherein the at least one weight is placed such that a selected portion of the aquatic toy sinks when submerged in water.

11. The aquatic toy of claim 1, wherein the at least one weight is at least one of metal, a weighted or weightable pocket or bladder, plastic, rubber, and wood.

12. The aquatic toy of claim 1, wherein the aquatic toy further comprises at least one additional fabric portion.

13. The aquatic toy of claim 12, wherein the additional fabric portion extends substantially downward from an upper portion of the hollow opening.

14. The aquatic toy of claim 12, wherein the additional fabric portion extends substantially upward from a lower portion of the hollow opening.

15. The aquatic toy of claim 12, wherein the additional fabric portion is weighted and/or buoyed.

16. The aquatic toy of claim 1, wherein the opening is sized such that an average adolescent can swim through the opening.

17. An apparatus, comprising:

a substantially planar fabric portion including an interior portion defining an opening and an exterior portion extending outwardly from the opening, the exterior portion including an unconstrained peripheral edge of the fabric portion;

at least one buoyancy member coupled to the exterior portion of the fabric such that a selected portion of the aquatic toy is buoyant; and at least one weight coupled to the exterior portion of the fabric portion such that a selected portion of the aquatic toy will sink when submerged in water.

18. An apparatus, comprising:

a fabric portion including an interior portion defining an opening and an exterior portion extending outwardly from the opening, the exterior portion including an unconstrained peripheral edge of the fabric portion;

at least one buoyancy member coupled to the exterior portion of the fabric portion; and at least one weight coupled to the exterior portion of the fabric portion, the fabric portion reconfigurable between a closed position in which the exterior portion is configured to be collapsed or folded and an open position in which the fabric portion is configured to extend into a substantially planar orientation when submerged in water.

* * * * *

UNITED STATES PATENT AND TRADEMARK OFFICE

CERTIFICATE OF CORRECTION

PATENT NO. : 6,923,706 B1
APPLICATION NO. : 10/776981
DATED : August 2, 2005
INVENTOR(S) : David A. Arias It is certified that error appears in the above-identified patent and that said Letters Patent is hereby corrected as shown below:

Column 6
Line 47, replace “aquatic toy” with --apparatus--.

Column 6
Lines 49-50 replace “aquatic toy” with --apparatus--.

Signed and Sealed this

Twenty-fifth Day of March, 2008

JON W. DUDAS
*Director of the United States Patent and Trademark Office*